US005086721A

United States Patent [19]

Burkard

[11] Patent Number: 5,086,721

[45] Date of Patent: Feb. 11, 1992

[54] LIGHTWEIGHT TRANSPORTABLE WATERCRAFT

[76] Inventor: David A. Burkard, P.O. Box 263, Hillsboro, Ohio 45133

[21] Appl. No.: 621,272

[22] Filed: Nov. 29, 1990

[51] Int. Cl.[5] ..... B63B 1/14

[52] U.S. Cl. ..... 114/61; 114/363

[58] Field of Search ..... 441/44, 45, 72, 73; 114/61, 363, 354

[56] References Cited

U.S. PATENT DOCUMENTS

| | | | |
|---|---|---|---|
| 2,958,306 | 11/1960 | Haxton et al. | 114/354 |
| 3,083,382 | 4/1963 | Havens et al. | 114/354 |
| 3,119,131 | 1/1964 | Yoder | 441/72 |
| 3,257,987 | 6/1966 | Liard | 114/354 |
| 3,968,532 | 7/1976 | Bailey | 114/352 |
| 3,986,219 | 10/1976 | Michowski | 114/354 |
| 4,295,236 | 10/1981 | Upchurch | 114/61 X |
| 4,303,033 | 12/1981 | King | 114/352 |
| 4,315,475 | 2/1982 | Echols | 114/61 |
| 4,449,473 | 5/1984 | McCrory et al. | 114/354 |
| 4,496,325 | 1/1985 | Tweg | 114/354 |
| 4,698,034 | 10/1987 | Anthonijsz | 114/352 |
| 4,768,454 | 9/1988 | Selken | 114/344 |

FOREIGN PATENT DOCUMENTS

| | | | |
|---|---|---|---|
| 1307305 | 9/1962 | France | 114/61 |
| 1222680 | 2/1971 | United Kingdom | 441/72 |

*Primary Examiner*—Sherman Basinger
*Attorney, Agent, or Firm*—John R. Flanagan

[57] ABSTRACT

A lightweight transportable watercraft includes a pair of pontoons disposed in spaced side-by-side relation to one another, a stool straddling the pontoons and extending over the space between the pontoons, and a pair of separate mounting bracket assemblies each attached on one of the respective pontoons. The mounting bracket assemblies pivotablly mount the stool to the pontoons such that the pontoons can float on water and concurrently pivot relative to the stool and relative to one another. Also, the mounting bracket assemblies releasably attach the stool to the pontoons such that the stool can be assembled and disassembled respectively to and from the pontoons in order to respectively put the watercraft together for use on water and to take the watercraft apart for transport and storage. Each mounting bracket assembly includes a plurality of connectors releasably and pivotally coupling the stool to portions of the respective mounting assemblies such that the connectors can be inserted and withdrawn to assembly and disassemble the stool to and from the pontoons. The watercraft also has a stabilizing assembly releasably and pivotally attached to and extending between the mounting bracket assemblies on the pontoons for limiting the amount of pivotal movement of the pontoons relative to one another.

20 Claims, 4 Drawing Sheets

LIGHTWEIGHT TRANSPORTABLE WATERCRAFT

BACKGROUND OF THE INVENTION

1. Field of the Invention

The present invention generally relates to small watercraft and, more particularly, is concerned with a lightweight transportable watercraft.

2. Description of the Prior Art

Avid fishermen like to fish small streams, lakes and farm ponds in rural parts of the country. Normally, they use ordinary watercraft, such as canoes and row boats, to do so. However, during periods of below-normal rainfall, most of these small bodies of water are at too low level to permit use of these watercraft without having to frequently disembark and carry them over riffles and low places in the water. During recent periods of severe, prolonged drought conditions, many fishermen have found themselves carrying their canoes and row boats more than they were riding in them. Typically, these watercraft are large, bulky and too heavy to lift and carry without exertion of substantial effort, thereby taking most of the enjoyment out the fishing outing.

The inventor herein has perceived a pressing need for a watercraft which will alleviate the above-described difficulties. In order to meet this need and thereby overcome these difficulties, the watercraft must be one that: first, requires very little water depth to draft or float; second, can be easily picked up by one person and lifted over a riffle or any low place in the water; third, can be quickly assembled and disassembled; fourth, can be easily carried by one person to and from the transporting vehicle; and, fifth, does not require a trailer or large transporting vehicle.

SUMMARY OF THE INVENTION

The present invention provides a watercraft designed to meet the above-defined performance criteria and thus satisfy the aforementioned needs. The watercraft of the present invention can be used in shallow waters, is easily assembled and disassembled, and is lightweight and transportable such that it can be carried by one person and transported conveniently in an automobile rear storage compartment or trunk.

Accordingly, the present invention is directed to a lightweight transportable watercraft which comprises: (a) a pair of pontoons disposed in spaced side-by-side relation to one another; (b) a stool straddling the pontoons and extending over the space between the pontoons; and (c) separate means in the form of a pair of separate mounting bracket assemblies each attached on one of the respective pontoons. The mounting bracket assemblies pivotally mount the stool to the pontoons such that the pontoons can float on water and concurrently pivot relative to the stool and relative to one another. The mounting bracket assemblies further releasably attach the stool to the pontoons such that the stool can be assembled and disassembled respectively to and from the pontoons in order to respectively put the watercraft together for use on water and to take the watercraft apart for transport and storage.

More particularly, the stool includes an upper seat and a lower frame straddling and extending over the spaced between the pontoons. The lower frame supports the seat above the space and generally between the pontoons. The lower frame includes a pair of elongated rigid members having upper middle portions and opposite end portions inclined outwardly and downwardly in opposite directions from the upper middle portions and defining pairs of legs for the stool. The lower frame also includes a pair of ross braces extending between and rigidly interconnecting the rigid members at respective opposite ends of the middle portions thereof.

Each mounting bracket assembly is fixed on a respective one of the pontoons at a middle location spaced from front and rear ends thereof. Each mounting bracket assembly includes a pair of first rigid members being spaced fore-and-aft from one another and extending transversely relative to a central longitudinal axis of the respective pontoon, and a single second rigid member extending fore-and-aft relative to the longitudinal axis of the pontoon, with second member extending between and rigidly interconnecting the first members.

Further, each mounting bracket assembly includes a plurality of connectors releasably and pivotally coupling the stool to portions of the respective mounting assemblies such that the connectors can be inserted and withdrawn to assemble and disassemble the stool to and from the pontoons. The connectors are retainer pins located along fore-and-aft extending pivotal axes defined by the pins approximately along longitudinal centerlines of the respective pontoons.

The watercraft also includes a stabilizing assembly releasably and pivotally attached to and extending between the mounting bracket assemblies on the pontoons for limiting the amount of pivotal movement of the pontoons relative to one another. The stabilizing assembly includes an elongated rigid bar extending between the mounting bracket assemblies, and a pair of retainer elements releasably and pivotally attaching opposite ends of the rigid bar to the mounting bracket assemblies.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached, drawings in which.

DETAILED DESCRIPTION OF THE INVENTION

In the following description, right hand and left hand references are determined by standing at the rear of the watercraft and facing in the direction of forward travel. Also, in the following description, it is to be understood that such terms as "right", "left", "front", "rear", etc., are words of convenience and are not to be construed as limiting terms.

Figure 1:
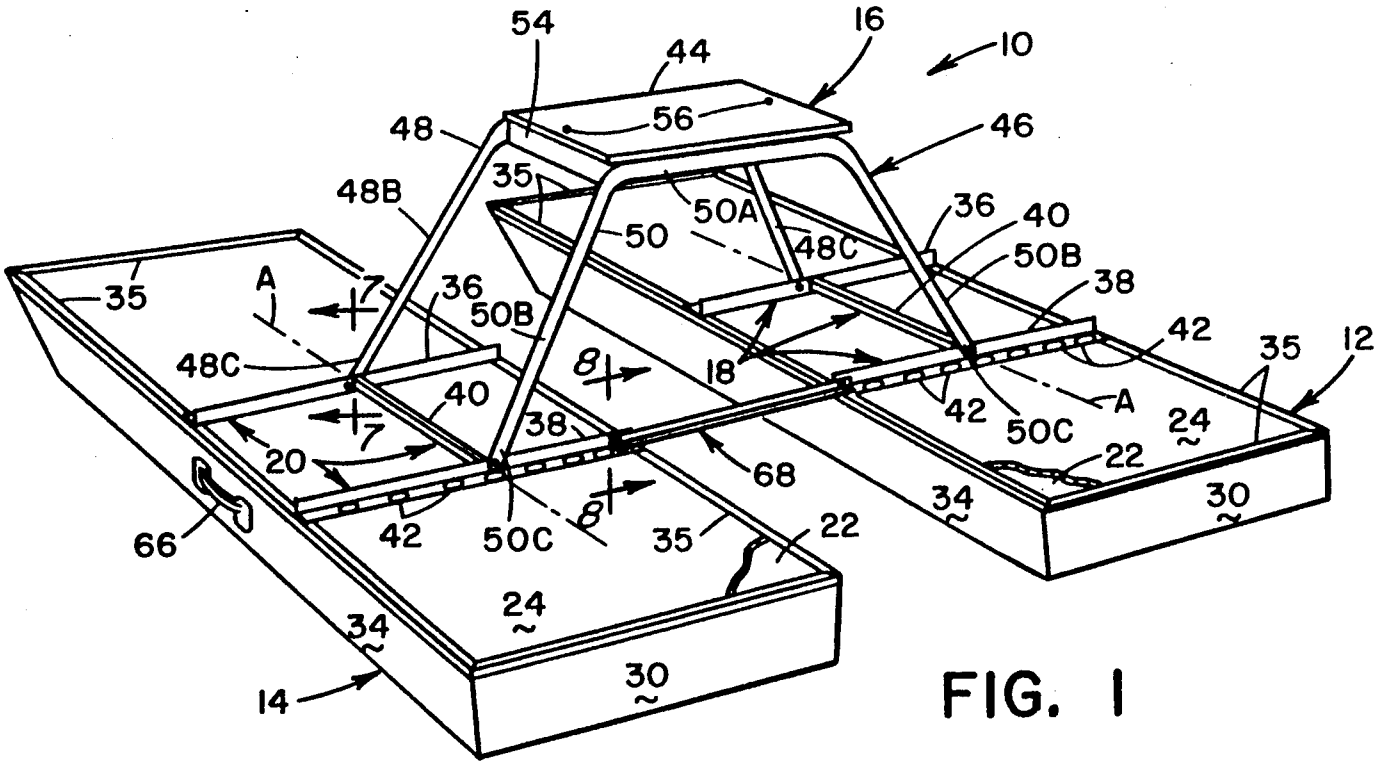
FIG. 1 is an assembled perspective view of a lightweight transportable watercraft in accordance with the present invention.
Figure 2:
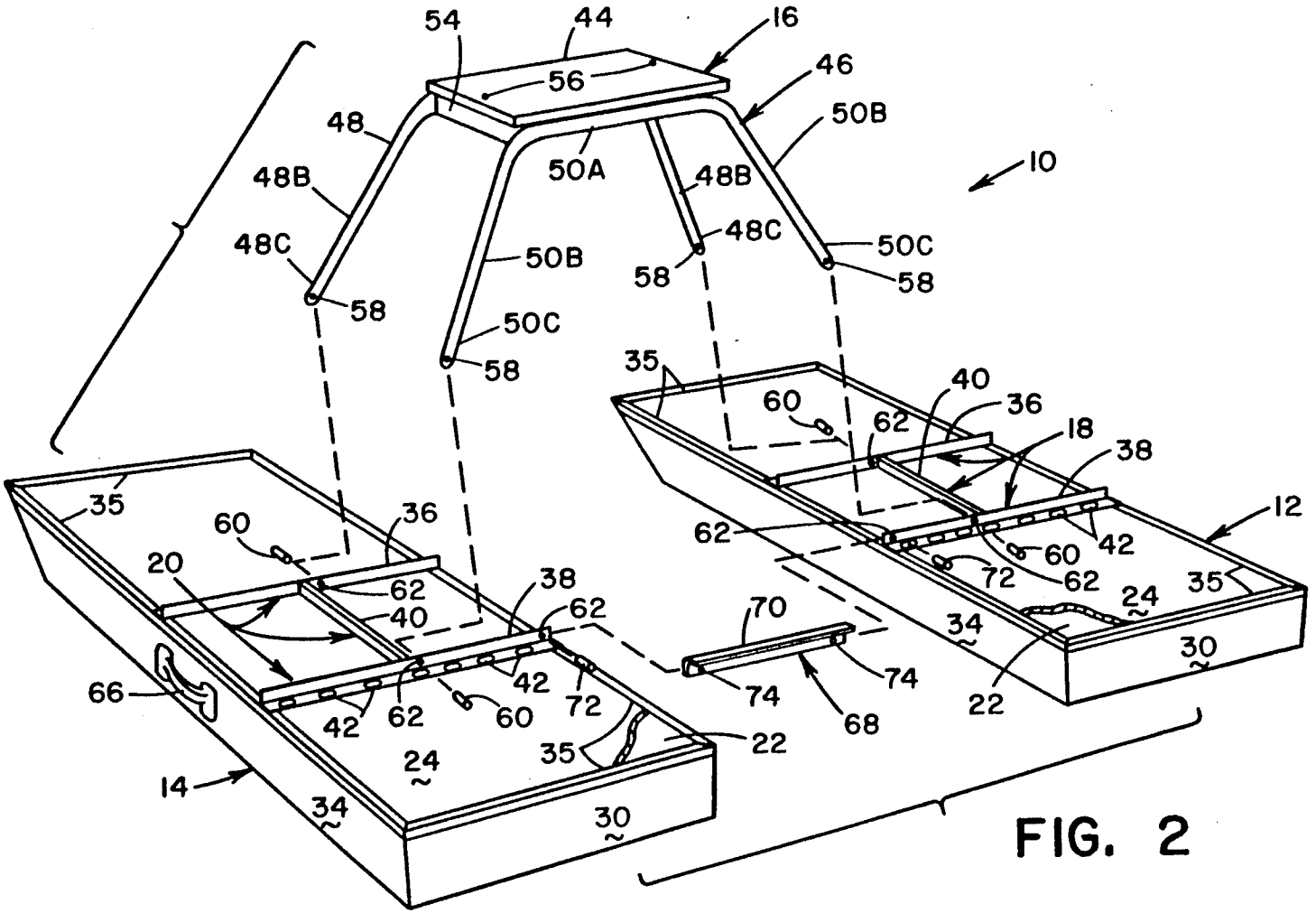
FIG. 2 is a disassembled perspective view of the watercraft of FIG. 1.
Figure 3:
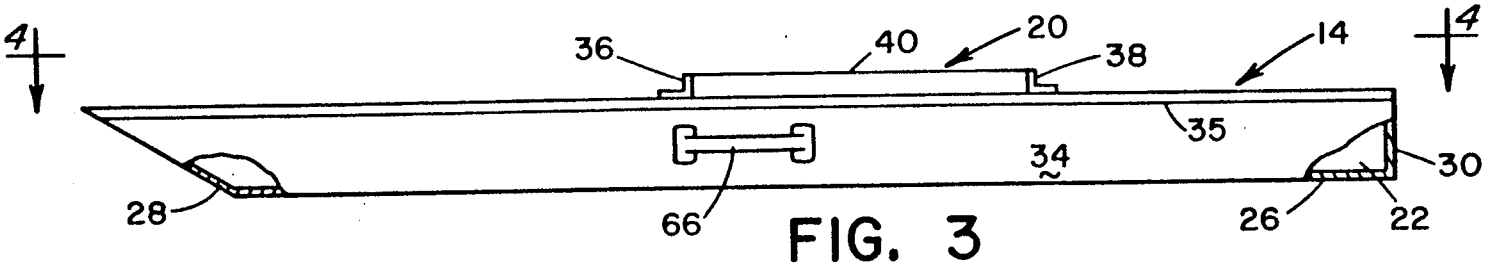
FIG. 3 is an enlarged side elevational view of the watercraft of FIG. 1.
Figure 4:
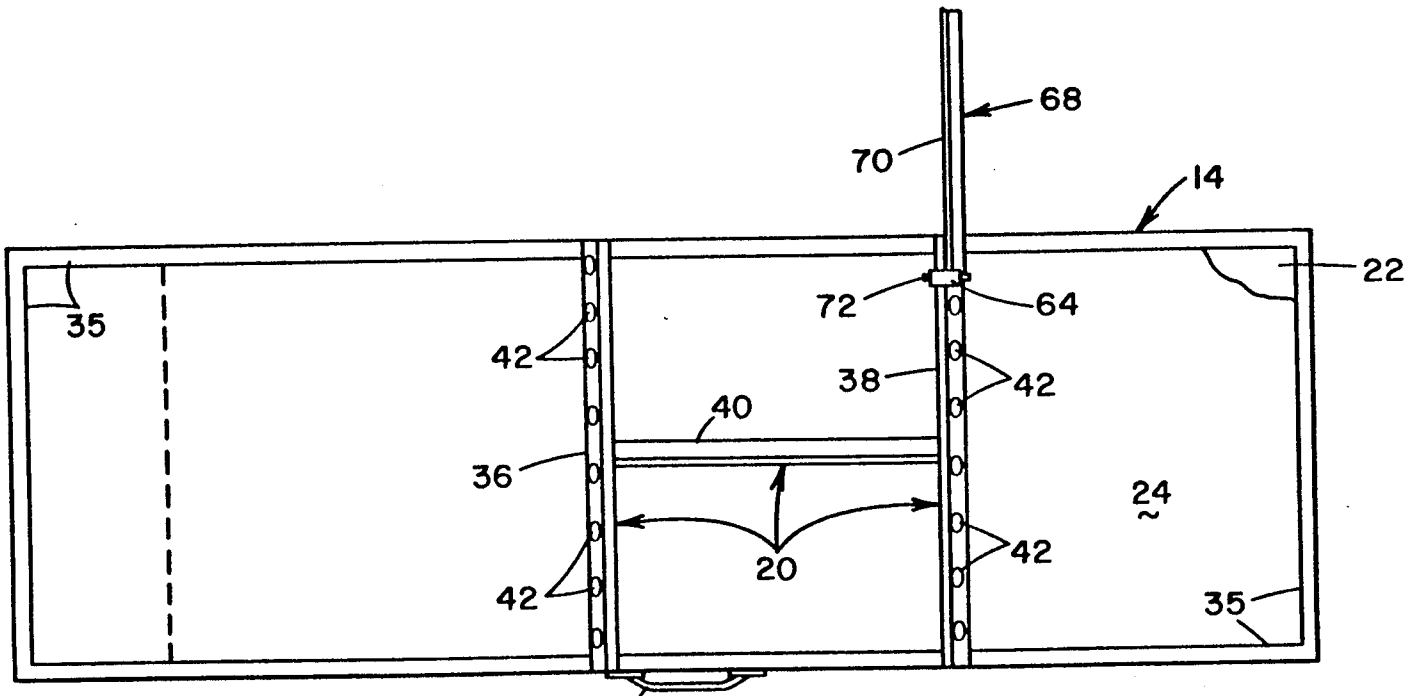
FIG. 4 is a top plan view of one of the pontoons and mounting bracket assemblies of the watercraft as seen along line 4—4, of FIG. 3 with the stool removed.
Figure 5:
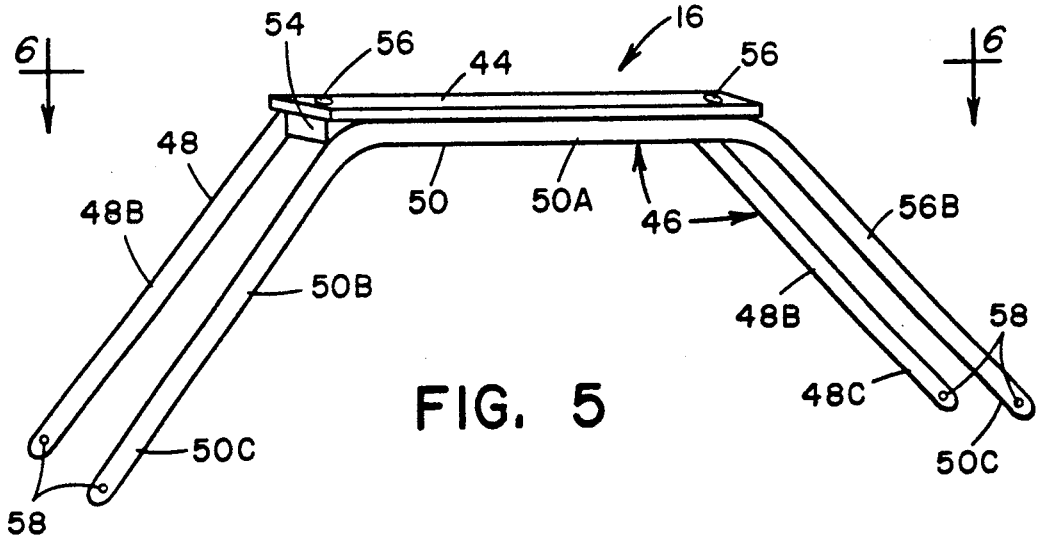
FIG. 5 is an enlarged perspective view of the stool of the watercraft removed from attachment to the mounting bracket assemblies.
Figure 6:
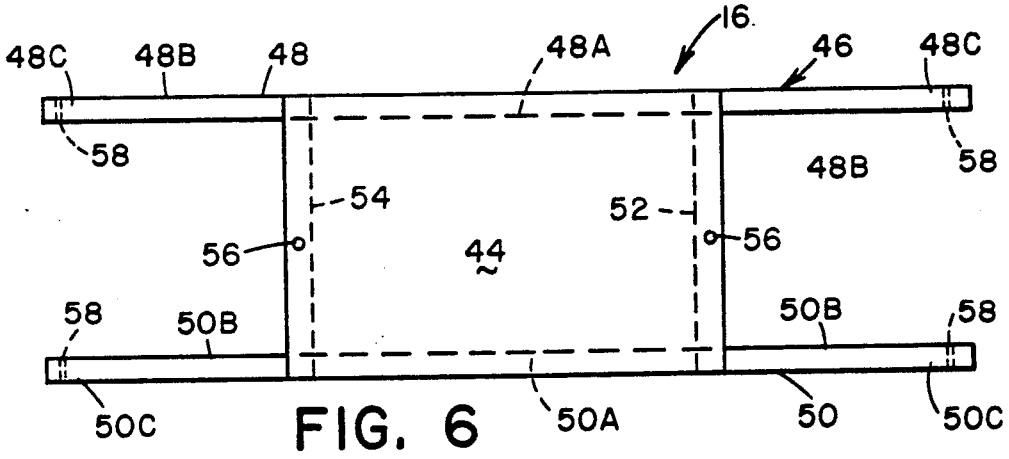
FIG. 6 is top plan view of the watercraft stool as seen along line 6—6 of FIG. 5.

Referring to the drawings, and particularly to FIGS. 1–3, there is shown a lightweight transportable watercraft of the present invention, generally designated 10. The lightweight watercraft 10 can quickly and easily be assembled for use in water and disassembled for placing in a storage compartment of a vehicle (not shown). The watercraft 10 when disassembled can be easily carried by one person and transported in the vehicle without the need to pull a separate trailer or to have a rack mounted on the roof of the vehicle to carry the watercraft. In its basic components, the watercraft 10 includes a pair of right and left pontoons 12 and 14, a stool 16 for supporting a user of the watercraft, and means in the form of a pair of separate right and left mounting bracket assemblies 18, 20 for releasably attaching and pivotally mounting the stool 16 to the pontoons 12 and 14.

Referring to FIGS. 1–4, each pontoon 12, 14 of the lightweight watercraft 10 is constructed of an elongated lightweight flotation body 22, a plurality of cover sheets 24, 26, 28, and a plurality of cover panels 30, 32, 34. The cover sheets 24, 26, 28 are attached to and cover respective top, bottom and inclined front surfaces of the body 22. The cover panels 30, 32, 34 are attached to and cover respective rear and opposite right and left lateral side surfaces of the body 22. An angle trim strip 35 extends about, overlaps with and is attached to the peripheral edge of the top cover sheet 24.

As an example only, suitable materials which can be used for constructing the pontoons 12, 14 are a block of rigid lightweight plastic foam, such as Styrofoam, for the flotation body 22, thin sheets of aluminum, such as of 0.018 inch thickness, for the cover sheets 24, 26, 28 and one inch painted pine boards for the cover panels 30, 32, 34. The cover sheets 24, 26, 28 and panels 30, 32, 34 can be attached by gluing to the respective surfaces of the flotation block 22.

Referring to FIGS. 1–4 and 7, each mounting bracket assembly 18, 20 of the watercraft 10 for releasably attaching and mounting the stool 16 to the pontoons 12, 14 is fixed to the top of one of the pontoons at a middle location spaced from front and rear ends thereof. Each mounting assembly 18, 20 is composed of a pair of fore-and-aft spaced, transverse extending front and rear rigid members 36, 38 and a single fore-and-aft extending, longitudinal rigid member 40 which extends between and rigidly interconnects the transverse front and rear rigid members 36, 38. The transverse and longitudinal rigid members 36, 38, 40 of the respective assemblies 18, 20 are rigidly attached together to constitute a rigid H-shaped structure and then attached to the respective pontoons 12, 14 by a plurality of fasteners 42.

As an example only, suitable materials which can be used to provide the transverse and longitudinal rigid members 36, 38, 40 for constructing the mounting bracket assemblies 18, 20 are 1¼ inch angle irons. The angle irons are welded together to provide the rigid H-shaped structures. The fasteners 42 used to secure the angle irons of the assemblies 18, 20 to the pontoons 12, 14 can be conventional metal screws.

Referring to FIGS. 1 3, 5 and 6, the stool 16 of the watercraft 10 extends over the middle space between the middle locations on the pontoons 12, 14 and is supported in a straddling relation to the pontoons 12, 14 by the mounting bracket assemblies 18, 20 attached on the pontoons. The stool 16 has an upper seat 44 and a lower frame 46 supporting the seat 44 above and generally between the pontoons 12, 14. The seat 44 is a flat plate that can be covered by a cushion, if desired. The frame 46 is composed of a pair of front and rear rigid members 48, 50 having upper middle portions 48A, 50A and opposite end portions 48B, 50B that are inclined outwardly and downwardly in opposite directions from opposite lateral edges of the upper middle portions 48A, 50A and defining pairs of legs 48B, 50B for the stool. Right and left cross braces 52, 54 extend between and rigidly interconnect the front and rear rigid members 48, 50 at the ends of their upper middle portions 48A, 50A. The seat 44 is placed upon and attached by a plurality of fasteners 56 to the cross braces 52, 54 and the middle portions 48A, 50A of the rigid members 48, 50.

As an example only, suitable materials which can be used for constructing the stool 16 are a plate of ½ inch plywood for the seat 44 and a pair of one inch diameter steel tubing each bent at two points to form one of the pair of stool rigid members 48, 50. The tubing is crimped at its opposite ends and drilled for defining openings 58 at the lower ends 48C, 50C of the members 48, 50. The middle portions 48A, 50A and the cross braces 52, 54 are welded together. The fasteners 56 can be carriage bolts.

Figure 7:
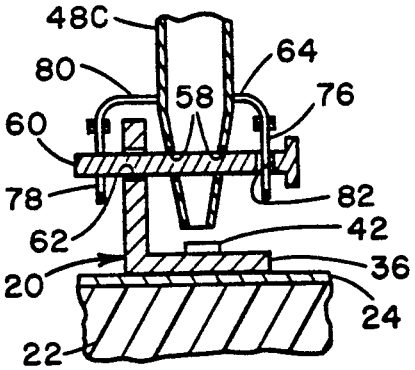
FIG. 7 is an enlarged fragmentary sectional view of one coupling between the stool and the mounting bracket assembly on one pontoon of the watercraft taken along along line 7—7 of FIG. 1.

Referring to FIGS. 1, 2 and 7, each of the mounting bracket assemblies 18, 20 also includes a plurality of releasable connectors 60 in the form of retainer pins pivotally coupling the lower opposite ends 48C, 50C of the stool members 48, 50 with the transverse members 36, 38 of the mounting bracket assemblies 18, 20. The releasable retainer pins 60 are inserted through the openings 58 in the lower opposite ends 48C, 50C of the stool members 48, 50 and aligned holes 62 defined through the transverse members 36, 38 of the mounting assemblies 18, 20. The retainer pins 60 pivotally connect the stool legs 48, 50 to the mounting assemblies 18, 20 on the pontoons 12, 14 along fore-and-aft extending pivotal axes A such that the pontoons 12, 14 can float on the water and pivot relative to the stool 16 and relative to one another. The pivotal axes A defined by the retainer pins 60 are located approximately along the longitudinal centerlines of the respective pontoons 12, 14. The retainer pins 60 can simply be insert or pulled out to assemble or disassemble the lower ends 48C, 50C of the stool members 48, 50 with the mounting bracket assemblies 18, 20 to assemble the watercraft 10 for use on water or take it apart for transport and storage. The pins 60 employ removable safety clips 64 to prevent unexcepted detachment. As seen in FIGS. 1–4, each of the pontoons 12, 14 has a handle 66 mounted to its outboard side for use in carrying the individual pontoons.

Figure 8:
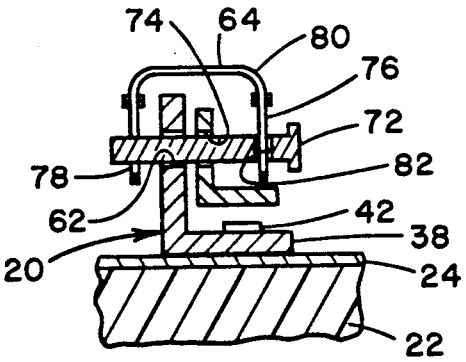
FIG. 8 is an enlarged fragmentary sectional view of one coupling between the stabilizing assembly and the mounting bracket assembly on one pontoon of the watercraft taken along line 8—8 of FIG. 1.

Also, as shown in FIGS. 1, 2, 4 and 8, the watercraft 10 includes a stabilizing assembly 68 attached to and extending between the pontoons 12, 14, preferably rearwardly of the stool 16. The stabilizing assembly 68 includes an elongated rigid bar 70 which extends between the rear ones of the transverse members 38 of the mounting bracket assemblies 18, 20 and a pair of retaining pins 72 which releasably and pivotally couple the opposite ends of the bar 70 at holes 74 therein to the members 38 at the holes 62 therein. Safety clips 64 prevent inadvertent removal of the pins 72. Referring to FIGS. 7 and 8, each safety clip 64 has opposite loop portions 76, 78 at opposite ends of and being interconnected by a springy bendable middle portion 80. One loop portion 76 is permanently mounted through a hole 82 in each of the respective pins 60, 72. The length of the middle portion 80 is less than that of each of the pins 60, 72. Thus, the middle portion 80 and the other loop portion 78 can be flexed outwardly and the loop portion 78 slipped over the opposite end of each of the pins 60, 72 without the need to be permanently attached to the pins in order to prevent inadvertent removal of the pins.

As an example only, the elongated bar 70 can be a 1¼ inch angle iron. The stabilizing assembly 68 thus limits the amount of pivotal movement of the pontoons 12, 14 can undergo relative to one another.

As can be readily understood from the above description, the watercraft 10 has a construction which is lightweight and requires very little water depth to draft or float. For example, the watercraft 10 can be constructed to weigh just over fifty pounds which one person can carry easily. Thus, in shallow lakes and ponds the watercraft 10 can be easily launched or removed into or from the water and lifted over a riffle or low place in the water without too much effort. Further, referring to FIG. 1, it will be observed that in view of the mounting of the stool 16 to the pontoons 12, 14 over the middle space solely between the middle locations on the pontoons spaced from front and rear ends thereof, the remaining front and rear spaces between the pontoons 12, 14 extending forwardly and rearwardly from the stool 16 contiguous with front and rear locations on the pontoons 12, 14, which correspondingly extend from the middle locations to the front and rear ends thereof, are unobstructed so as to permit a user of the watercraft 10 to easily disembark therefrom into the water between the pontoons 12, 14 in order to transport the watercraft 10 over the low places in the water.

It is thought that the present invention will be understood from the foregoing description and it will be apparent that various changes may be made thereto without departing from its spirit and scope or sacrificing all of its material advantages, the form hereinbefore described being merely preferred or exemplary embodiment thereof.

Having thus described the invention, what is claimed is:

1. A lightweight transportable watercraft, comprising:

(a) a pair of elongated pontoons having respective longitudinal centerlines and being disposed in spaced side-by-side relation to one another;

(b) a stool straddling said pontoons and extending over a middle space between respective middle locations on said pontoons spaced from front and rear ends of said pontoons, said stool including an upper seat and a lower frame straddling and extending over said middle space between said middle locations on said pontoons, said lower frame having an upper middle portion substantially underlying and supporting said upper seat above the level of said pontoons and above said middle space between said middle locations on said pontoons, said lower frame also having opposite end portions extending laterally from opposite sides of said upper seat and being inclined outwardly and downwardly in opposite directions from said upper middle portion of said lower frame and in transverse relation to said longitudinal centerlines of said pontoons; and (c) separate means attached on each one of said middle locations on said respective pontoons and generally aligned with said stool for pivotally mounting said opposite end portions of said lower frame of said stool to said pontoons such that said pontoons can float on water and concurrently pivot relative to said stool and relative to one another and such that remaining front and rear spaces between said pontoons extending forwardly and rearwardly from said stool contiguous with front and rear locations on said pontoons which correspondingly extend from said middle locations to said front and rear ends thereof are unobstructed so as to permit a user of said watercraft to disembark therefrom into the water between said pontoons in order to transport said watercraft, said separate means further for releasably attaching said opposite end portions of said lower frame of said stool to said pontoons such that said stool can be assembled and disassembled respectively to and from said pontoons in order to respectively put said watercraft together for use on water and to take said watercraft apart for transport and storage.

2. A lightweight transportable watercraft, comprising:

(a) a pair of elongated pontoons having respective longitudinal centerlines and being disposed in spaced side-by-side relation to one another;

(b) a stool straddling said pontoons and extending over a middle space between respective middle locations on said pontoons spaced from front and rear ends of said pontoons, said stool including an upper seat and a lower frame straddling and extending over said middle space between said middle locations on said pontoons, said lower frame having an upper middle portion substantially underlying and supporting said upper seat above the level of said pontoons and above said middle space between said middle locations on said pontoons, said lower frame also having opposite end portions extending laterally from opposite sides of said upper seat and being inclined outwardly and downwardly in opposite directions from said upper middle portion of said lower frame and in transverse relation to said longitudinal centerlines of said pontoons; and (c) a pair of separate mounting bracket assemblies each attached on one of said middle locations of said respective pontoons and generally aligned with said stool, each said mounting bracket assembly includes a pair of first rigid members being spaced fore-and-aft from one another and extending transversely relative to said longitudinal centerline of said pontoon, said first rigid members being generally aligned with spaced fore-and-aft ends of said upper seat of said stool, said mounting bracket assemblies pivotally mounting said opposite end portions of said lower frame of said stool to said pontoons such that said pontoons can float on water and concurrently pivot relative to said stool and relative to one another and such that remaining front and rear spaces between said pontoons extending forwardly and rearwardly of said stool contiguous with front and rear locations on said pontoons which correspondingly extend from said middle locations to said front and rear ends thereof are unobstructed so as to permit a user of said watercraft to disembark therefrom into the water between said pontoons in order to transport said watercraft.

3. The watercraft of claim 1 wherein said lower frame includes a pair of rigid members defining said upper middle portion and said opposite end portions of said lower frame, said opposite end portions of said rigid members defining pairs of legs of said stool.

4. The watercraft of claim 3 wherein said lower frame also includes a pair of cross braces extending between and rigidly interconnecting said rigid members at respective opposite ends of said middle portion thereof.

5. The watercraft of claim 1 wherein each of said separate means is a mounting bracket assembly fixed on said respective one of said pontoons at said middle location spaced from front and rear ends thereof, each said mounting bracket assembly including a pair of first rigid members being spaced fore-and-aft from one another and extending transversely relative to said longitudinal centerline of said pontoon, said first rigid members being generally aligned with spaced fore-and-aft ends of said upper seat of said stool.

6. The watercraft of claim 5 wherein each said mounting bracket assembly also includes a single second rigid member extending fore-and-aft relative to said longitudinal centerline of said pontoon, said second rigid member extending between and rigidly interconnecting said first rigid members.

7. The watercraft of claim 1 wherein each of said separate means includes a plurality of connectors releasably and pivotally coupling said stool to portions of said separate means such that said connectors can be inserted and withdrawn to assemble and disassemble said stool to and from said pontoons.

8. The watercraft of claim 7 wherein said connectors are retainer pins being located along fore-and-aft extending pivotal axes.

9. The watercraft of claim 8 wherein said pivotal axes defined by said connectors are located approximately along said longitudinal centerlines of said respective pontoons.

10. The watercraft of claim 1 further comprising:

a stabilizing assembly releasably and pivotally attached to and extending between said separate means on said pontoons for limiting the amount of pivotal movement of said pontoons relative to one another.

11. The watercraft of claim 10 wherein said stabilizing assembly includes:

an elongated rigid member extending between said separate means; and a pair of retainer elements releasably and pivotally attaching opposite ends of said separate means.

12. A lightweight transportable watercraft, comprising:

(a) a pair of elongated pontoons having respective longitudinal centerlines and being disposed in spaced side-by-side relation to one another;

(b) a stool straddling said pontoons and extending over a middle space between respective middle locations on said pontoons spaced from front and rear ends of said pontoons, said stool including an upper seat and a lower frame straddling and extending over said middle space between said middle locations on said pontoons, said lower frame having an upper middle portion substantially underlying and supporting said upper seat above the level of said pontoons and above said middle space between said middle locations on said pontoons, said lower frame also having opposite end portions extending laterally from opposite sides of said upper seat and being inclined outwardly and downwardly in opposite directions from said upper middle portion of said lower frame and in transverse relation to said longitudinal centerlines of said pontoons; and (c) a pair of separate mounting bracket assemblies each attached on one of said middle locations of said respective pontoons and generally aligned with said stool, said mounting bracket assemblies pivotally mounting said opposite end portions of said lower frame of said stool to said pontoons such that said pontoons can float on water and concurrently pivot relative to said stool and relative to one another and such that remaining front and rear spaces between said pontoons extending forwardly and rearwardly of said stool contiguous with front and rear locations on said pontoons which correspondingly extend from said middle locations to said front and rear ends thereof are unobstructed so as to permit a user of said watercraft to disembark therefrom into the water between said pontoons in order to transport said watercraft from the water, said mounting bracket assemblies further releasably attaching said lower frame of said stool to said pontoons such that said stool can be assembled and disassembled respectively to and from said pontoons in order to respectively put said watercraft together for use on water and to take said watercraft apart for transport and storage; and (d) a stabilizing assembly located below said stool and releasably and pivotally attached to and extending between said mounting bracket assemblies on said pontoons for limiting the amount of pivotal movement of said pontoons relative to one another.

13. The watercraft of claim 12 wherein said stabilizing assembly includes:

an elongated rigid member extending between said mounting bracket assemblies; and a pair of retainer elements releasably and pivotally attaching opposite ends of said rigid member to said mounting bracket assemblies.

14. The watercraft of claim 12 wherein each said pontoon includes an elongated lightweight flotation body composed of a block of rigid lightweight plastic foam.

15. The watercraft of claim 14 wherein each said pontoon further includes a plurality of coverings attached to and enclosing top, bottom, front, rear, and opposite side surfaces of said body.

16. The watercraft of claim 12 wherein each said mounting bracket assembly includes:

a pair of first rigid members being spaced fore-and-aft from one another and extending transversely relative to said longitudinal centerline of said pontoon; and a single second rigid member extending fore-and-aft relative to said longitudinal centerline of said pontoon, said second member extending between and rigidly interconnecting said first members.

17. The watercraft of claim 21 wherein said lower frame includes a pair of rigid members defining said upper middle portion and said opposite end portions of said lower frame, said opposite end portions of said rigid members defining pairs of legs of said stool, said rigid members of said lower frame being generally aligned with said first rigid members of each said mounting bracket assembly.

18. The watercraft of claim 17 wherein said lower frame also includes a pair of cross braces extending between and rigidly interconnecting said rigid members at respective opposite ends of said middle portion thereof.

19. The watercraft of claim 12 wherein each said mounting bracket assembly includes a plurality of connectors releasably and pivotally coupling lower opposite ends of said lower frame of said stool to portions of said respective mounting assemblies such that said connectors can be inserted and withdrawn to assemble and disassemble said stool to and from said pontoons.

20. The watercraft of claim 19 wherein said connectors are retainer pins being located along fore-and-aft extending pivotal axes defined approximately along said longitudinal centerlines of said respective pontoons.

* * * * *